United States Patent [19]

Kuerten et al.

[11] B 4,013,744

[45] Mar. 22, 1977

[54] PROCESS FOR THE MANUFACTURE OF FIBRIDS OF THERMOPLASTICS MATERIALS

[75] Inventors: Heribert Kuerten, Mannheim; Otto Nagel, Neustadt; Richard Sinn, Ziegelhausen; Werner Weinle, Mannheim; Peter Engler, Frankenthal, all of Germany

[73] Assignee: Badische Anilin- & Soda-Fabrik Aktiengesellschaft, Ludwigshafen (Rhine), Germany

[22] Filed: Feb. 26, 1973

[21] Appl. No.: 335,783

[44] Published under the second Trial Voluntary Protest Program on March 30, 1976 as document No. B 335,783.

[30] Foreign Application Priority Data

Feb. 25, 1972 Germany ..... 2208921

[52] U.S. Cl. ..... 264/11; 264/14

[51] Int. Cl.[2] ..... B01J 2/06

[58] Field of Search ..... 264/11, 4, 14

[56] References Cited

UNITED STATES PATENTS

| | | | |
|---|---|---|---|
| 3,042,970 | 7/1962 | Terenzi | 264/11 |
| 3,389,194 | 6/1968 | Somerville | 264/4 |

*Primary Examiner*—Robert F. White
*Assistant Examiner*—James R. Hall
*Attorney, Agent, or Firm*—Johnston, Keil, Thompson & Shurtleff

[57] ABSTRACT

A process for the manufacture of fibrids of thermoplastics materials by extruding molten thermoplastics through dies and breaking up the extrudate into fibers by means of a liquid medium causing shear stresses within a small volume, to which end the extrudate is passed to a zone of high energy dissipation so that it is completely divided up into fibers of the desired size in a single pass.

7 Claims, 2 Drawing Figures

PROCESS FOR THE MANUFACTURE OF FIBRIDS OF THERMOPLASTICS MATERIALS

Figure 1:
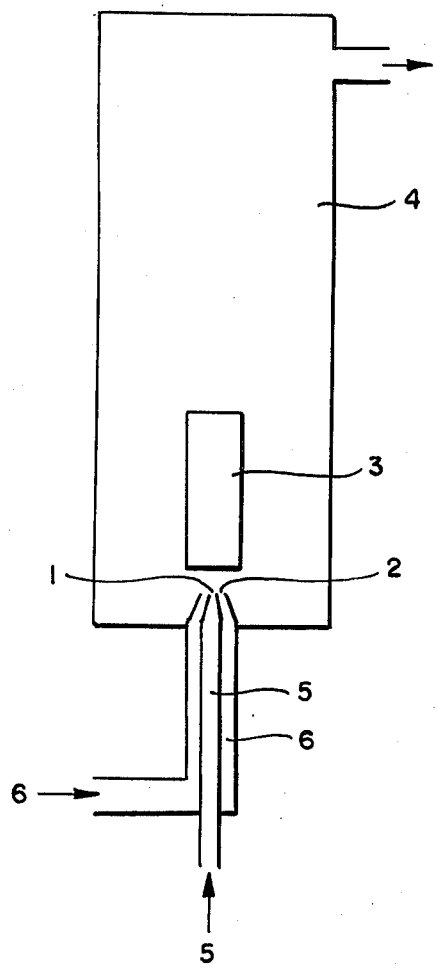

A large number of processes for the manufacture of staple fibers or fibrids is known. in the aerodynamic spinning processes, gases, usually air, or vapors are used as spinning medium. The spinning processes are divided into processes for the manufacture of monofilaments of virtually constant diameter and unconventional processes for the manufacture of short fibers or fibrids showing variations in diameter and length. The process of the invention is of the latter kind.

In the prior art processes, the plastics material is melted either in a screw extruder or in a pressurized melting pot, from which it is passed through heated pipelines to the spinning point. At this point, gas or vapor (steam) impinges on the extrudate leaving the die orifices at an angle thereto and at high velocity.

It is also known to make fibrids from polymers by forcing polymer solutions through constricted die orifices under high pressure.

It is also possible to make fibrids by precipitation. Polymers dissolved in suitable solvents are precipitated from solution by the addition of a non-solvent and subjection to shear forces at the moment of precipitation.

Other methods are known as interfacial condensation methods, which comprise withdrawing freshly made polymer in the form of an extremely thin film and converting it to fibers by intense stirring in a liquid such as water.

Polyolefin fibers may be produced during precipitation polymerization in statu nascendi if the polymerization is carried out at a relatively high reaction rate in a suitable solvent and in the presence of a coordination catalyst and under the action of shear stresses.

Another method of making fibrids or a sludge of fibrids is to stretch a sheet of crystalline polyolefins in one direction only and to produce fibers therefrom by the action of external mechanical forces, for example by treatment with fluted rolls, and finally cutting the fibers into short lengths. In one variation of this method, the oriented sheeting obtained on stretching is cut up and then milled in aqueous medium.

All of these known processes aim at making fibrids. These fibrids vary in size and usually also in shape. They may be in the form of fibers and/or ribbons. There are also sheet-like types. Usually, fibrids have fibrils, barbs and/or weave-like structures which enable the individual fibers to become entangled. It is usually desired, depending on the purpose to which the fibrids are to be put, that they be similar to natural fibers as regards shape and size. For the purpose of paper manufacture, they must be similar to wood pulp fibers.

However, the prior art processes and apparatus are not without their drawbacks. For example, powder particles or crumb-like particles may be produced in addition to the fibers, large amounts of gaseous medium may have to be heated and consumed per unit of fiber volume, the fibers produced may show a very wide range of variations, it may be necessary to use solvents which must then be recovered and also lead to waste water problems, or the processes may require expensive apparatus and thus be uneconomical to operate.

It is thus an object of the invention to avoid the above drawbacks and provide a process for the manufacture of fibrids of thermoplastics materials which requires simple apparatus not prone to breakdown and which enables fibers to be spun directly from the melt.

We have found that fibrids of thermoplastics materials may be obtained in a very simple manner by extruding melts through dies when spinning of the continuous molten extrudate leaving the die orifice is effected with a liquid medium by the action of shear stresses within a small volume caused by passing the molten extrudate to a zone of high energy dissipation to cause it to be completely broken up into fibers of the desired size in a single pass.

The process utilizes apparatus for carrying out the above process, consisting of a two-component or multicomponent nozzle projecting into a container 4 which is filled with liquid and in which a tube which is small compared with the container and which has any desired cross-section and which acts as impulse exchange chamber 3 and is disposed at a short distance from the die orifice coaxially with an imaginary extension of the die axis such that the said tube can accomodate the jets of media leaving the said die orifices 1,2.

Particularly advantageous melt-spinning results are obtained when one or more jets of liquid are passed through nozzles at velocities of from 10 to 100 m/s to the impulse exchange chamber in the container filled with liquid so that they travel through the cylindrical tube together with the relatively slow-moving liquid contained in said container.

The small cylindrical tubular chamber constitutes an impulse exchange chamber, since the total impulse (momentum) of the jets of liquid is converted to other energy virtually only within said chamber, i.e. within a small volume. The mean diameter of this impulse exchange chamber should be from two to 20 times the average equivaltne nozzle diameter and its length should be from two to 30 times its hydraulic diameter.

This arrangement of the jets of liquid and impulse exchange chamber within a large container causes the liquid in the container not to be simply entrained in the general direction of flow of the jet of liquid, as in the case of a free jet, but to move toward and into the inlet of the impulse exchange chamber at a rate determined by the momentum of the said jets.

If the molten plastics material is fed through the nozzle orifices in such a manner that it forms strands or ribbons of molten material and passes between the high-velocity propulsive jets and the entrained liquid, the melt is subjected to a shear gradient which causes it to be broken up into fibers.

Suitable plastics materials are all types known to be suitable for the manufacture of fibers and which may have from low to high molecular weights depending on the purpose to which the resulting fibrids are to be put, for example polyolefins such as polyethylene and polypropylene and their waxes and extended waxes, polyamides, polyesters, polyvinly chloride and polystyrene.

The molten plastics material is fed to the nozzle or die from a pressurized melting pot or from an extruder. Depending on the type of thermoplastics material used, the melts may have various temperatures. All temperatures between the melting point and the maximum temperature possible at which no chemical change of the melt takes place may be used.

Conveniently, the temperatures of the melts are near the upper limit in order to achieve minimum viscosities. The pressure applied to the melt is determined by its temperature and by the geometry of the die.

The spinning medium used is generally an inert liquid, advantageously water. The use of water, as opposed to air, is advantageous because its density is $10^3$ times greater than that of air. This means that to achieve a given impulse (momentum), water may be used at a correspondingly lower rate of flow. The water is circulated, the fibrids being collected in a sieve, and there are thus virtually no waste water problems. The temperature of the water depends on that of the plastics melt and on the type and size of the fibrids to be produced, since the water will cool the thermoplastics melt and thus fix the shape of the fibrids. The velocity of the propulsive water jet is dependent on the shear gradient required and on the desired fiber structure and is thus again determined by the temperature and viscosity of the melt.

The entire spinning operation takes place within the small impulse exchange chamber. The large container may be dispensed with if the relatively slow-moving stream of liquid entrained from said container is replaced by liquid coming from a pump. In this way, liquid containing finished fibrids will not be reentrained and definite residence times of the liquid in the impulse exchange chamber are achieved.

The impulse exchange chamber generally has a constant cross-section or a cross-section which increases in the direction of flow.

The impulse exchange chamber should be oriented in the direction of flow of the liquids entering it and may be of various designs adapted to the shapes of the nozzles used, cylindrical or frustoconical tubes being usually employed. If the impulse exchange chamber is in the form of a cylindrical tube, its length should be from two to 30 times its diameter. If its cross-section is not circular or is not constant over its entire length, its length should be from two to 30 times its hydraulic diameter. The mean diameter of the inlet of the impulse exchange chamber should be from two to 20 times the diameter of the propulsive nozzle or, if a number of nozzles are used, the diameter of a nozzle equivalent in area to said nozzles.

Apparatus useful in the process of the invention are described below with reference to FIGS. 1 and 2 of the accompanying drawings. In FIG. 1, the apparatus is enclosed in a large container. For the sake of clarity, however, the nozzles and the impulse exchange chamber are drawn on a larger scale than the container. The reference numerals have the following meanings: 1 is the outlet orifice for the propulsive jet, 2 is the outlet orifice for the melt, 3 is the impulse exchange chamber, 4 is the container, 5 is the feed-line for the spinning medium (water) and 6 is the feed-line for the melt. The nozzle orifices for the molten plastic material may comprise a circle of round nozzles disposed around the propulsive jet nozzle or may be in the form of arcuate slots disposed concentrically with respect to the propulsive jet nozzle.

Figure 2:
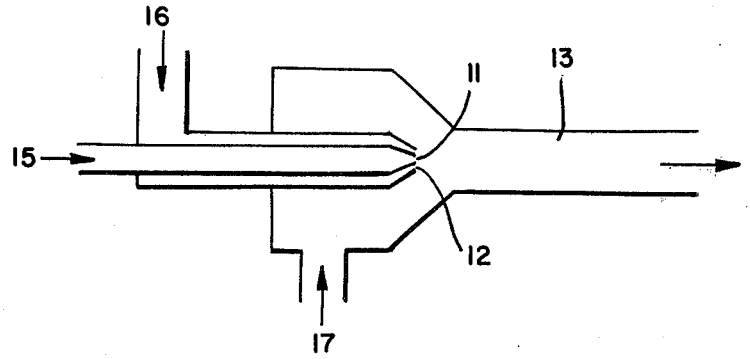

The apparatus of FIG. 2 comprises an outlet orifice 11 for the propulsive jet and an outlet orifice 12 for the melt. The melt is supplied through the feed-line 16, and the spinning medium (water) is supplied through the feed-line 15. The slow-moving medium (water) is fed through the feed-line 17. The spinning is effected in the tube 13 which acts as the impulse exchange chamber.

The process of the invention can produce various types of fibrids. The shape and size of the fibrids produced vary according to the conditions of operation and the plastics materials used. Their appearance ranges from very fine, powder-like fibers to fibers having the character of cotton wool. The upper limit of the fiber length is 100 times the diameter of the fiber.

Variations in the size and shape of any particular batch of fibers may be extended or restricted by selecting suitable conditions of operation and a suitable design of the spinning apparatus. Since the exchange of momentum and energy takes place within a very small volume, the fiber spectrum of any one batch is generally small.

EXAMPLE 1

A polyethylene wax having an average molecular weight of 3,000 and a melting point of approx. 95°C is melted in a pressurized melting pot and passed to the spinning apparatus through heated pipelines. The temperature of the melt at the nozzle is 150°C and the viscosity of the melt is about 3 poise. The molten wax is transported under a pressure of 2 atmospheres. The water in the propulsive jet has a velocity of 37 m/s, it being pumped to the nozzle under a pressure of 7 atmospheres. The water contains an antistatic agent in a concentration of 0.3 g/l and has a temperature of 80°C.

There are obtained microfine fibers having an outward appearance of powder. The fibers show hardly any ramification and show virtually no tendency to form lumps. The diameter of the fibers is between 4 and 25 $\mu$m, their length being from 5 to 500 $\mu$m.

EXAMPLE 2

A polyethylene wax having an average molecular weight of 6,000 and a melting point of about 100°C is melted and passed to the spinning apparatus in the manner described in Example 1. The temperature of the melt at the nozzle is 130°C and the viscosity of the melt is approx. 6 poise. The wax melt is forced through the nozzle at a pressure of 2 atmospheres. The velocity of the water in the propulsive jet is 15 m/s and the water pressure is 2 atmospheres.

The water contains an antistatic agent at the concentration stated in Example 1 and has a temperature of 80°C.

The resulting fibrids are very fine and distinctly ramified, this causing entangling of the fibers leading to agglomerates thereof. The fibrous character is recognizable without optical aids. The diameter of the fibers ranges from 25 to 125 $\mu$m and the lengths of the fibers are from 75 to 1,250 $\mu$m.

EXAMPLE 3

An extended wax based on polyethylene having a melt index of 1,000 (2.16 kg/190°C) and a melting point of about 95°C is melted and passed to the spinning apparatus in the manner described in Example 1. The temperature of the melt at the nozzle is 150°C and the viscosity of the melt is about 3 poise. The wax melt is forced through the nozzle at a pressure of 2 atmospheres. The velocity of the water in the propulsive jet is 30 m/s and the water pressure is 5 atmospheres. The temperature of the water is 60°C.

The resulting fibrids are very similar to cellulose pulp, being in part markedly fibrillated and ramified and thus entangled. The diameter of the fibers is from 25 to 75 $\mu$m and their length ranges from 500 to 1,500 $\mu$m.

EXAMPLE 4

Example 3 is repeated except that the temperature of the melt at the nozzle is 170°C and viscosity of the melt is about 2 poise. The melt is forced through the nozzle at a pressure of 1.5 atmospheres and the velocity of the water in the propulsive jet is 20 m/s, the water being at a pressure of 3 atmospheres and a temperature of 60°C.

The resulting fibrids are finer and on average longer than in Example 3 and are very similar to cotton wool. The diameter of the fibers ranges from 25 to 40 μm, whilst the lengths of the fibers are from 500 to 1,000 μm.

EXAMPLE 5

An extended wax based on polyethylene having a melt index of 220 (2.16 kg/190°C) and a melting point of approx. 120°C is melted and fed to the spinning apparatus in the manner described in Example 1. The temperature of the melt at the nozzle is 155°C and its viscosity is about 500 poise. The molten wax is forced through the nozzle at a pressure of 2 atmospheres, and the velocity of the water in the propulsive jet is 25 m/s, its pressure being 4 atmospheres and its temperature 90°C.

The resulting fibers are fine and long and have the character of hair. The diameter of the fibers ranges from 50 to 250 μm and their lengths are from 3 to 250 mm.

The melt is fed to the shear zone between the propulsive jet and the entrained liquid through a circle of nozzles in Examples 1, 2, 4 and 5 and through arcuate nozzles in Example 3.

We claim:

1. A process for the manufacture of fibrids of a thermoplastic polymer material which comprises extruding strands of molten thermoplastic polymer material through orifices of die means into a shear gradient zone between and created by a propulsive jet of liquid flowing from a nozzle adjacent said die means at a velocity of 10–100 meters per second and flowing in the same direction as said strands and a slower moving liquid body entrained by the propulsive jet and located in a liquid-filled zone surrounding said orifices and the propulsive jet, passing said strands, the propulsive jet and the entrained liquid immediately and directly into and through a tubular impulse exchange zone having a mean diameter of two to 20 times the diameter of said nozzle of said propulsive jet and a length of 2–30 times its hydraulic diameter to provide shear stresses acting on said strands within said impulse exchange zone, and causing said strands of molten thermoplastic polymer to solidfy by the cooling of said melt by said liquid and to be broken up into fibrids by said shear stresses within said impulse exchange zone.

2. A process as claimed in claim 1 wherein said tubular impulse exchange zone is a cylindrical tube.

3. A process as claimed in claim 1 wherein said tubular impulse exchange zone is located in said liquid filled zone and is immersed in the liquid.

4. A process as claimed in claim 1 wherein said tubular impulse exchange zone is immediately downstream of said liquid filled zone.

5. A process as claimed in claim 1 wherein the thermoplastic polymer material is a member selected from the group consisting of polyolefins, waxes thereof and extended waxes thereof.

6. A process as claimed in claim 1 wherein said propulsive jet nozzle is disposed coaxially within a circle of said orifices.

7. A process as claimed in claim 1 wherein the propulsive jet liquid is water.

* * * * *